US009164431B2

(12) United States Patent
Yamanaka

(10) Patent No.: US 9,164,431 B2
(45) Date of Patent: Oct. 20, 2015

(54) CLEANING MEMBER, DEVELOPING DEVICE, AND IMAGE FORMING APPARATUS

(71) Applicant: KYOCERA DOCUMENT SOLUTIONS INC., Osaka (JP)

(72) Inventor: Tatsuya Yamanaka, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/155,206

(22) Filed: Jan. 14, 2014

(65) Prior Publication Data

US 2014/0205304 A1 Jul. 24, 2014

(30) Foreign Application Priority Data

Jan. 21, 2013 (JP) ..... 2013-008459

(51) Int. Cl.
*G03G 15/08* (2006.01)

(52) U.S. Cl.
CPC ..... *G03G 15/0889* (2013.01); *G03G 15/0856* (2013.01); *G03G 2215/0897* (2013.01)

(58) Field of Classification Search
CPC ..... G03G 15/0856; G03G 15/0889; G03G 2215/0897
USPC ..... 399/27, 61
See application file for complete search history.

(56) References Cited

U.S. PATENT DOCUMENTS

| | | | | |
|---|---|---|---|---|
| 5,526,100 | A * | 6/1996 | Misago et al. | 399/29 |
| 6,463,225 | B1 * | 10/2002 | Abe et al. | 399/27 |
| 2003/0185588 | A1 * | 10/2003 | Takami et al. | 399/111 |
| 2006/0269313 | A1 * | 11/2006 | Takagi | 399/90 |
| 2008/0056772 | A1 * | 3/2008 | Utsumi et al. | 399/254 |
| 2008/0124156 | A1 * | 5/2008 | Tsui et al. | 399/351 |
| 2009/0297178 | A1 * | 12/2009 | Kakuta et al. | 399/27 |
| 2011/0222871 | A1 * | 9/2011 | Suzuki et al. | 399/27 |

FOREIGN PATENT DOCUMENTS

| | | | | |
|---|---|---|---|---|
| JP | 03029980 | A * | 2/1991 | G03G 15/08 |
| JP | 08110694 | A * | 4/1996 | G03G 15/08 |
| JP | 2003167420 | A * | 6/2003 | G03G 15/08 |
| JP | 2004163822 | A * | 6/2004 | G03G 15/08 |
| JP | 2006098818 | A * | 4/2006 | |

(Continued)

OTHER PUBLICATIONS

Machine translation of JP 2007240795 A.*

*Primary Examiner* — David Bolduc
(74) *Attorney, Agent, or Firm* — Studebaker & Brackett PC

(57) ABSTRACT

A developing device includes an agitating member agitating and rotating a developer, a developer amount detecting part detecting the developer amount, and a cleaning member being attached to the agitating member to have has an attachment part, a first cleaning part and a second cleaning part and to clean a detecting surface of the developer amount detecting part. The attachment part is formed by an end part of a wire and attached to the agitating member. The first cleaning part is formed by an intermediate part of the wire, and extends from an end part of the attachment part to reach the detecting surface. The second cleaning part is formed by an another end part of the wire, and is constructed by closely winding the wire, protruded to a location in front of the detecting surface and has a greater width than the detecting surface.

9 Claims, 8 Drawing Sheets

(56) References Cited

FOREIGN PATENT DOCUMENTS

| | | | | |
|---|---|---|---|---|
| JP | 2007-121583 | A | | 5/2007 |
| JP | 2007-240795 | A | | 9/2007 |
| JP | 2007240796 | A | * | 9/2007 |

* cited by examiner

CLEANING MEMBER, DEVELOPING DEVICE, AND IMAGE FORMING APPARATUS

INCORPORATION BY REFERENCE

This application is based on and claims the benefit of priority from Japanese Patent application No. 2013-008459 filed on Jan. 21, 2013, the entire contents of which are incorporated herein by reference.

BACKGROUND

The present disclosure relates to a cleaning member clearing adhered developer from a detection range of a developer amount detecting part, and to a developing device and an image forming apparatus.

An image forming apparatus forms an image, such as a toner image or the like, on a photosensitive drum by, for example, a developing device developing an electrostatic latent image formed on the photosensitive drum by using a developer such as toner or the like. This image is transferred to a sheet by a transferring unit, and is fixed by a fixing part, and then is ejected out of the image forming apparatus.

The developing device includes, for example, an agitating member agitating the developer contained in a housing, and a developing roller carrying the agitated developer and supplying the developer to the photosensitive drum. Furthermore, the developing device includes a developer amount detecting part detecting whether or not a sufficient amount of the developer is contained. The image forming apparatus performs a control such that the developing device is replenished with the developer if the developer amount detecting part does not detect a sufficient amount of the developer. Due to this, the amount of the developer in the housing is kept constant, so that desired images can be formed in a good manner.

However, when the developer stagnates in the housing and adheres to a detecting surface of the developer amount detecting part and others, even if the amount of the developer is actually insufficient, the developer amount detecting part may falsely detect that the amount of the developer in the housing is sufficient. Therefore, in order to clean the detecting surface of the developer amount detecting part, the developing device is equipped with a cleaning member in some image forming apparatuses.

In an example of such a developing device, the cleaning member has an elastic part that is fixed at a detecting surface side from a rotation shaft of an agitating member and that is elastically deformable in a parallel direction to the detecting surface, and a cleaning part that is connected to the elastic part and that slidingly contacts the detecting surface as the agitating member rotates. Then, the length from an axis of the rotation shaft to a distal end portion of the cleaning part is designed to be longer than the length from the axis of the rotation shaft to an inner wall surface of a casing. This cleaning part includes a first cleaning part constructed of an end of a first coil spring part that extends in a substantially perpendicular direction to the rotation shaft, a second cleaning part formed by bending a distal end of the first cleaning part substantially perpendicularly to the detecting surface of the detecting means and then bending a distal end of the bent part substantially perpendicular in a direction that has a predetermined angle with respect to the first cleaning part, and a third cleaning part formed by substantially perpendicularly bending a distal end of the second cleaning part in a direction toward the detecting surface.

However, the cleaning member provided on the developing device is not able to clear the developer stagnating at a location apart forwardly from the detecting surface of the developer amount detecting part, even if the cleaning member passes over the detecting surface. Even if the cleaning member is merely bent with respect to the detecting surface, the developer stagnating at the location apart forwardly from the detecting surface is not sufficiently cleared, and then, the developer may sometimes remain at that location. Then, in the case where the detection range of the developer amount detecting part reaches a location in front of the detecting surface, the developer amount detecting part detects the developer remaining in front of the detecting surface, and therefore, cannot accurately measure the amount of the developer present in the housing, but falsely detects that the amount of developer is sufficient. That is, there is caused a problem that a desired sensor output cannot be obtained.

If another component part is added to the cleaning member in order to clear the developer resining at a location apart forwardly from the detecting surface of the developer amount detecting part, there is a possibility of increasing the number of man-hours for the production of the cleaning member and the production cost.

SUMMARY

A developing device in accordance with an aspect of the present disclosure includes an agitating member, a developer amount detecting part and a cleaning member. The agitating member agitates a developer by rotating in a casing that contains the developer. The developer amount detecting part detects amount of the developer in the casing. The cleaning member is attached to the agitating member and cleans a detecting surface of the developer amount detecting part. The cleaning member has an attachment part, a first cleaning part and a second cleaning part. The attachment part is formed by an end part of a wire and is attached to the agitating member. The first cleaning part is formed by an intermediate part of the wire being successive from the attachment part, and configured to extend from an end part of the attachment part so as to reach the detecting surface of the developer amount detecting part. The second cleaning part is formed by an another end part of the wire being successive from the first cleaning part, and is constructed by bending the wire so that adjacent portions of the wire are closely contiguous to each other, so as to be protruded to a location in front of the detecting surface of the developer amount detecting part and to have a greater width than the detecting surface.

In accordance with an embodiment of the present disclosure, an image forming apparatus includes a developing device. The developing device includes an agitating member, a developer amount detecting part and a cleaning member. The agitating member agitates a developer by rotating in a casing that contains the developer. The developer amount detecting part detects amount of the developer in the casing. The cleaning member is attached to the agitating member and cleans a detecting surface of the developer amount detecting part. The cleaning member has an attachment part, a first cleaning part and a second cleaning part. The attachment part is formed by an end part of a wire and is attached to the agitating member. The first cleaning part is formed by an intermediate part of the wire being successive from the attachment part, and configured to extend from an end part of the attachment part so as to reach the detecting surface of the developer amount detecting part. The second cleaning part is formed by an another end part of the wire being successive from the first cleaning part, and is constructed by bending the wire so that adjacent portions of the wire are closely contiguous to each other, so as to be protruded to a location in front of the detecting surface of the developer amount detecting part and to have a greater width than the detecting surface.

A cleaning member in accordance with an embodiment of the present disclosure is configured to clean a detecting surface of a developer amount detecting part in a developing device. The cleaning member includes an attachment part, a first cleaning part and a second cleaning part. The attachment part is formed by an end part of a wire and is attached to an agitating member of the developing device. The first cleaning part is formed by an intermediate part of the wire being successive from the attachment part, and configured to extend from an end part of the attachment part so as to reach the detecting surface of the developer amount detecting part. The second cleaning part is formed by an another end part of the wire being successive from the first cleaning part, and is constructed by bending the wire so that adjacent portions of the wire are closely contiguous to each other, so as to be protruded to a location in front of the detecting surface of the developer amount detecting part and to have a greater width than the detecting surface.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Figure 1:
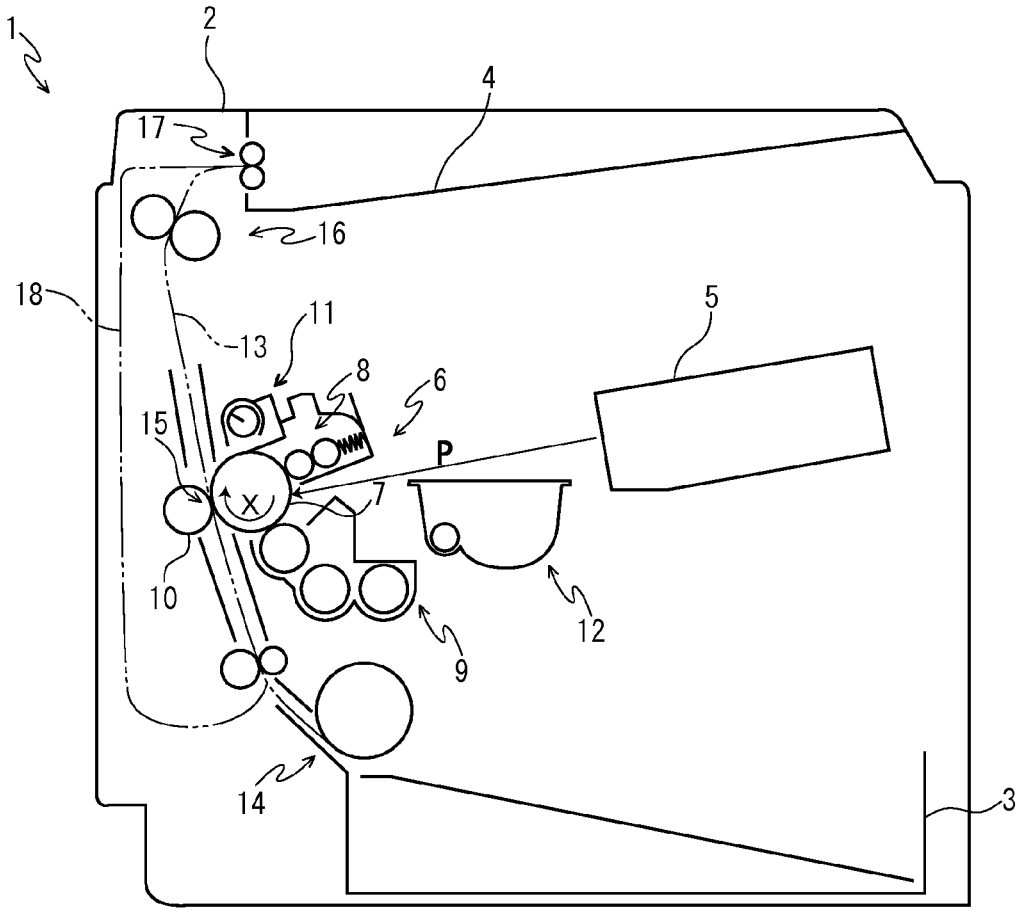
FIG. 1 is a schematic diagram schematically showing a printer in accordance with an embodiment of the present disclosure.

First, with reference to FIG. 1, the entire structure of a printer 1 as an image forming apparatus will be described. FIG. 1 is a schematic diagram schematically showing the printer according to an embodiment of the present disclosure. Hereinafter, it will be described so that the front side of the printer 1 is positioned at the right-hand side of FIG. 1. In the printer 1 of the embodiment, development is carried out by using a developer, such as a magnetic single-component toner.

As shown in FIG. 1, the printer 1 includes a box-formed printer main body 2. In a lower part of the printer main body 2, a sheet feeding cartridge 3 storing sheets (not shown) is installed and, in a top face of the printer main body 2, a sheet ejecting tray 4 is formed.

In an upper forward part of the printer main body 2, an exposure device 5 composed of a laser scanning unit (LSU) is installed. In a rear part of the printer main body 2, an image forming unit 6 is arranged. In the image forming unit 6, a photosensitive drum 7 as an image carrier is rotatably installed. Around the photosensitive drum 7, a charger 8, a developing device 9, a transfer roller 10 and a cleaning device 11 are located along a rotating direction (refer to an arrow X in FIG. 1) of the photosensitive drum 7. The developing device 9 is installed to an installed part (not shown) in the printer 1 and connected to a developer case 12, such as a toner container, in order to receive supply of the developer.

In the rear part of the printer main body 2, a sheet conveying path 13 is arranged from a lower side to an upper side. That is, the printer 1 is configured in a vertical conveying manner. At an upstream end in the conveying path 13, a sheet feeder 14 is positioned. At an intermediate stream part in the conveying path 13, a transferring unit 15 composed of the photosensitive drum 7 and transfer roller 10 is positioned. At a downstream part in the conveying path 13, a fixing device 16 is positioned. At a downstream end in the conveying path 13, a sheet ejecting part 17 is positioned. In the rear of the conveying path 13, an inversion path 18 for duplex printing is arranged.

Next, the operation of forming an image by the printer 1 having such a configuration will be described.

When the power is supplied to the printer 1, various parameters are initialized and initial determination, such as temperature determination of the fixing device 16, is carried out. Subsequently, in the printer 1, when image data is inputted and a printing start is directed from a computer or the like connected with the printer 1, image forming operation is carried out as follows.

First, the surface of the photosensitive drum 7 is uniformly electric-charged by the charger 8. Then, exposure corresponding to the image data on the photosensitive drum 7 is carried out by a laser light (refer to an arrow P in FIG. 1) from the exposure device 5, thereby forming an electrostatic latent image on the surface of the photosensitive drum 7. Subsequently, the electrostatic latent image is developed by the toner supplied from the developing device 9 to the photosensitive drum 7, and thereby, a toner image is generated.

On the other hand, a sheet fed from the sheet feeding cartridge 3 by the sheet feeder 14 is conveyed to the transferring unit 15 in a suitable timing for the above-mentioned image forming operation, and then, the toner image on the photosensitive drum 7 is transferred onto the sheet in the transferring unit 15. The sheet with the transferred toner image is conveyed to a downstream side in the conveying path 13 to go forward to the fixing device 16, and then, the toner image is fixed on the sheet in the fixing device 16. The sheet with the fixed toner image is ejected from the sheet ejecting part to the sheet ejecting tray 4. The toner and electrical charge remained on the photosensitive drum 7 is removed by the cleaning device 11.

Figure 2:
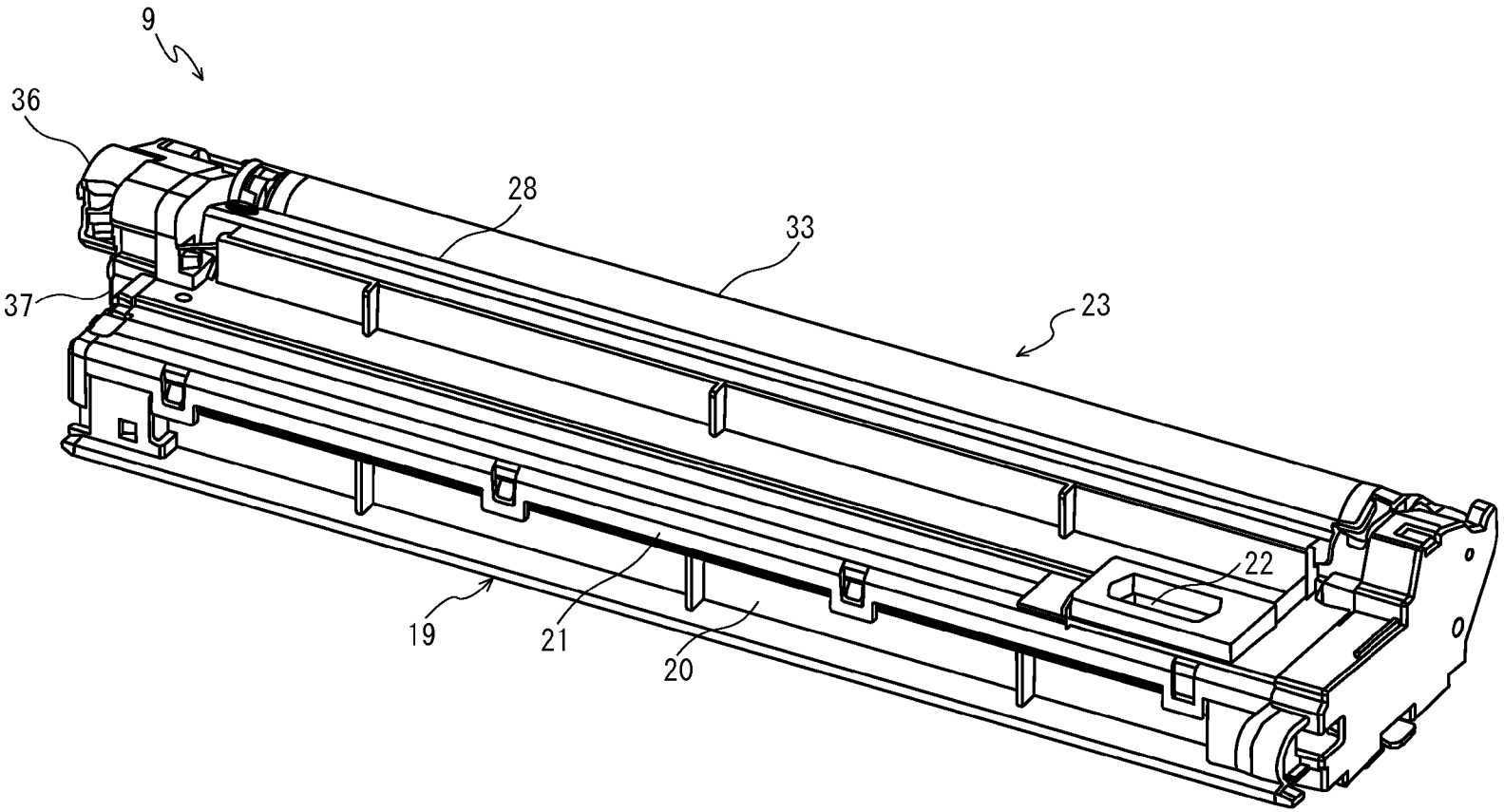
FIG. 2 is a perspective view showing a developing device, in a state that a lid part is closed, in the printer in accordance with the embodiment of the present disclosure.
Figure 3:
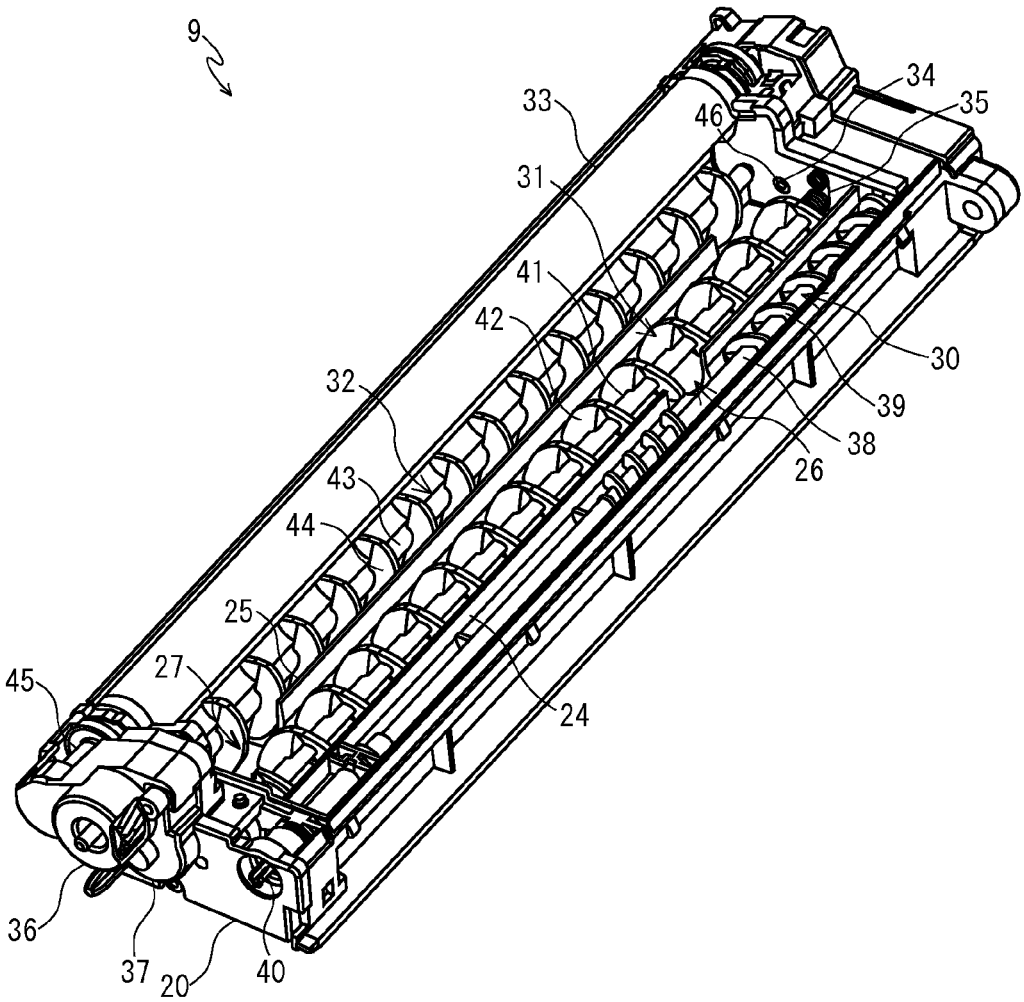
FIG. 3 is a perspective view showing the developing device, in a state that a lid part is opened, in the printer in accordance with the embodiment of the present disclosure.
Figure 4:
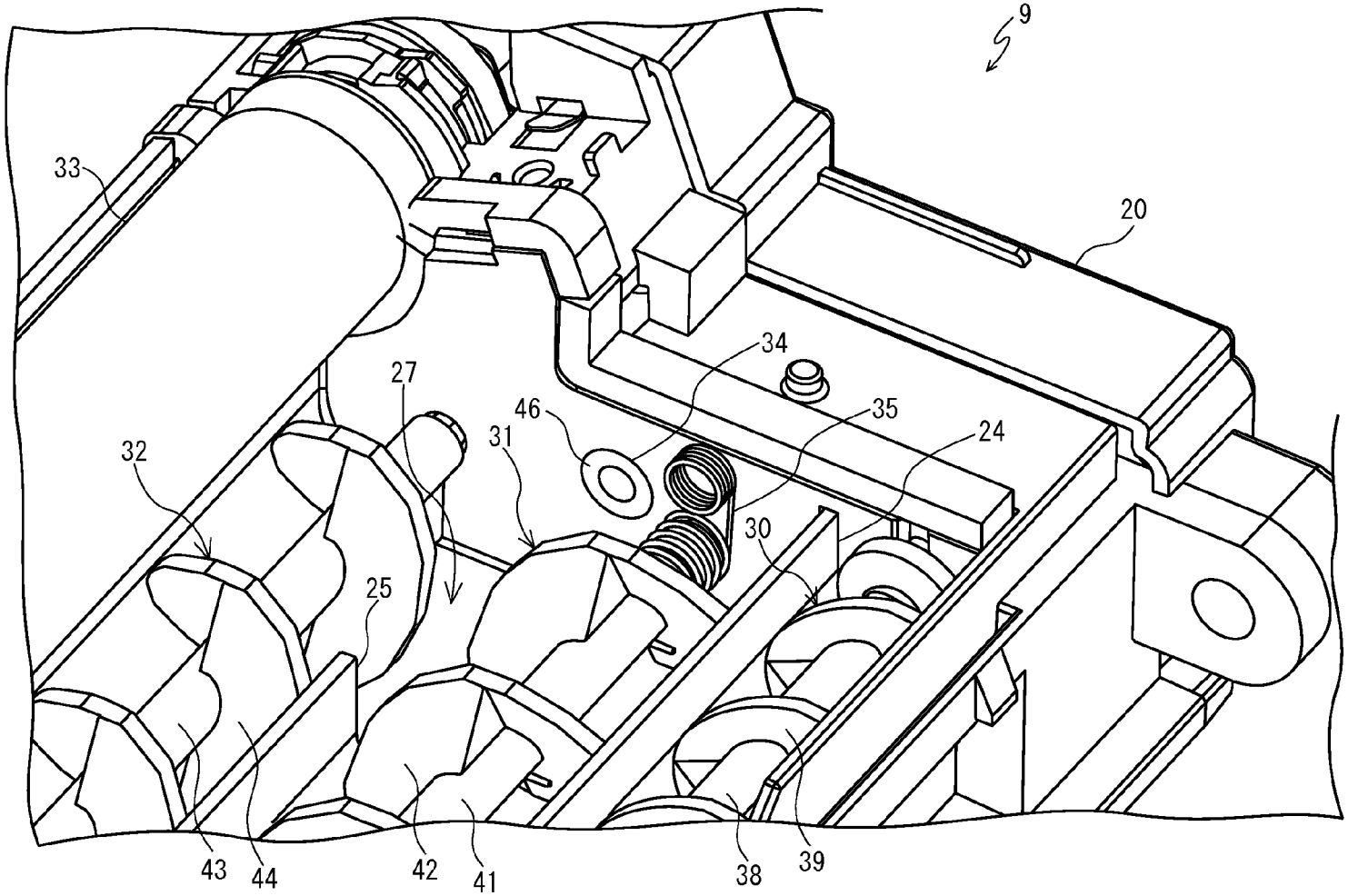
FIG. 4 is a partially enlarged view of the developing device in the printer in accordance with the embodiment of the present disclosure.

Next, with reference to FIGS. 2-4, the developing device 9 will be described in detail. FIG. 2 is a perspective view showing the developing device, in a state that a lid part is closed, in the printer in accordance with the embodiment of the present disclosure. FIG. 3 is a perspective view showing the developing device, in a state that a lid part is opened, in the printer in accordance with the embodiment of the present disclosure. FIG. 4 is a partially enlarged view of the developing device shown in FIG. 3.

As shown in FIG. 2, the developing device 9 has an elongated housing (casing) 19. This housing 19 is constructed of a box-shaped housing main body 20 whose upper portion is open, and a lid part 21 that covers the upper portion of the housing main body 20. The lid part 21 has an end part in a longitudinal direction in which a supply port 22 is opened configured to be connected to the developer case 12 and to receive supply of the developer. The housing 19 has an elongated rear end portion in which an opening part 23 is arranged in a state that the lid part 21 attached to the housing main body 20. The developing device 9 is disposed so that the opening part 23 faces to the photosensitive drum 7.

As shown in FIGS. 3 and 4, on a bottom part of the housing main body 20, an elongated first partition 24 is provided between a conveying screw 30 and a first agitating screw 31 mentioned below, and an elongated second partition 25 is provided between the first agitating screw 31 and a second agitating screw 32. The first partition 24 has a gap 26, in the vicinity of the supply port 22, conveying the developer from the conveying screw 30 to the first agitating screw 31. The second partition 25 has gaps 27, in both ends in the longitudinal direction, conveying the developer from the first agitating screw 31 to the second agitating screw 32.

The lid part 21 of the housing 19 is equipped with a cleaning blade 28 that is provided at an end part in which the opening part 23 is formed and that is configured to clean a surface of a developing roller 33 mentioned below (see FIG. 2).

The developing device 9 is equipped with the conveying screw 30, the first agitating screw (first agitating member) 31, the second agitating screw (second agitating member) 32 and the developing roller 33 inside the housing 19. The developing device 9 is equipped with a developer amount detecting part 34 detecting the amount of developer in the housing 19, and a cleaning member 35 removing the developer stagnating or adhered in a detection range of the developer amount detecting part 34.

Furthermore, the developing device 9 is equipped with a first drive force input portion 36 that has a gear and others inputting drive force from a drive source (not shown), such as an electric motor, installed in the printer 1 and a drive force transmission mechanism 37 that has an idle gear and others transmitting the input drive force to the first agitating screw 31 and second agitating screw 32. The gear of the first drive force input portion 36 and the idle gear of the drive force transmission mechanism 37 are interconnected by gear mesh.

The conveying screw 30 is equipped with an elongated conveying rotation shaft 38 and a helical conveying vane member 39 provided around the conveying rotation shaft 38. The conveying screw 30 is rotatably provided in an elongated front end portion of the housing 19 at the opposite side to the opening part 23 so as to be in parallel to the longitudinal direction of the elongated front end part. The conveying vane member 39 is provided in an end part of the conveying rotation shaft 38 in the longitudinal direction below the supply port 22 of the housing 19. The other end part of the conveying rotation shaft 38 in the longitudinal direction is equipped with a second drive force input part 40, such as gears and others, inputting the same drive force from the aforementioned drive source to the conveying screw 30.

That is, in the conveying screw 30, as the second drive force input part 40 is rotated by the drive force from the drive source, the conveying rotation shaft 38 rotates together with the conveying vane member 39, and, due to the rotation of the conveying vane member 39, the developer supplied through the supply port 22 is conveyed to the first agitating screw 31 via the gap 26 of the first partition 24.

The first agitating screw 31 is equipped with an elongated first agitating rotation shaft 41 and a helical first agitating vane member 42 provided around the first agitating rotation shaft 41. The second agitating screw 32 is equipped with an elongated second agitating rotation shaft 43 and a helical second agitating vane member 44 provided around the second agitating rotation shaft 43. The first agitating screw 31 is disposed in the rear of the conveying screw 30 and parallel and adjacent to the conveying screw 30. The second agitating screw 32 is disposed in the rear of and parallel and adjacent to the first agitating screw 31. The first agitating screw 31 and second agitating screw 32 are rotatably provided in a bottom part of the housing 19. The first agitating vane member 42 and second agitating vane member 44 are provided from one ends to other ends of the first agitating rotation shaft 41 and second agitating rotation shaft 43, respectively, in the longitudinal direction. The other ends of the first agitating rotation shaft 41 and second agitating rotation shaft 43 in the longitudinal direction is equipped with the gears and others that is connected by gear mesh to the idle gear of the drive force transmission mechanism 37.

That is, in the first agitating screw 31, by the drive force inputted from the first drive force input part 36 via the drive force transmission mechanism 37, the first agitating rotation shaft 41 is rotated together with the first agitating vane member 42, and, due to the rotation of the first agitating vane member 42, the developer conveyed from the conveying screw 30 is agitated and simultaneously conveyed to the second agitating screw 32 via one gap 27 of the second partition 25. In the second agitating screw 32, by the drive force inputted from the first drive force input part 36 via the drive force transmission mechanism 37, the second agitating rotation shaft 43 is rotated together with the second agitating vane member 44, and, due to the rotation of the second agitating vane member 44, the developer conveyed from the first agitating screw 31 is agitated and simultaneously conveyed to the developing roller 33.

Incidentally, the developer that is not carried by the developing roller 33 because a predetermined amount is exceeded, that is, surplus developer, is returned to the second agitating screw 32, and returned from which to the first agitating screw 31 via the other gap 27 of the second partition 25. In this manner, the first agitating screw 31 and second agitating screw 32 convey and agitate the developer supplied from the developer case 12.

The developing roller 33 is provided in the elongated rear end part of the housing 19 so as to be in parallel to its longitudinal direction and adjacent to a rear side of the second agitating screw 32. The developing roller 33 is equipped with a development rotation shaft 45, thereby being arranged rotatable. Apart of a rotation surface of the developing roller 33 is exposed through the opening part 23. The developing roller 33 and the photosensitive drum 7 are disposed adjacent to each other so that their rotation surfaces face to each other. An end part of the development rotation shaft 45 in the longitudinal direction is equipped with gears and others that are connected by mesh with the gear of the first drive force input part 36.

That is, in the developing roller 33, as the development rotation shaft 45 is rotated by the drive force transmitted from the first drive force input part 36, the developer conveyed from the second agitating screw 32 is carried. Furthermore, the developing roller 33 supplies the carrying developer to the adjacent photosensitive drum 7 via the opening part 23 so that an electrostatic latent image formed on the surface of the photosensitive drum 7 is developed.

The developer amount detecting part 34 is buried in an inner-side surface of an end part of the housing 19 in the longitudinal direction between the first agitating screw 31 and second agitating screw 32. The developer amount detecting part 34 has a detecting surface 46 that extends along the inner-side surface. The developer amount detecting part 34 detects whether or not a predetermined amount of the developer is stored in the housing 19, that is, is able to detect whether or not the developer is present within a detection range of the detecting surface 46. The developer amount detecting part 34 outputs a signal indicating a result of the detection to a controller (not shown) of the printer 1. The controller is able to decide whether a sufficient amount of the developer is stored in the developing device 9. For example, the developer amount detecting part 34 is constructed of, for example, a magnetic sensor, such as a magnetic permeability sensor, that detects the amount of the developer by measuring the magnetic permeability of the developer in the periphery.

Figure 5:
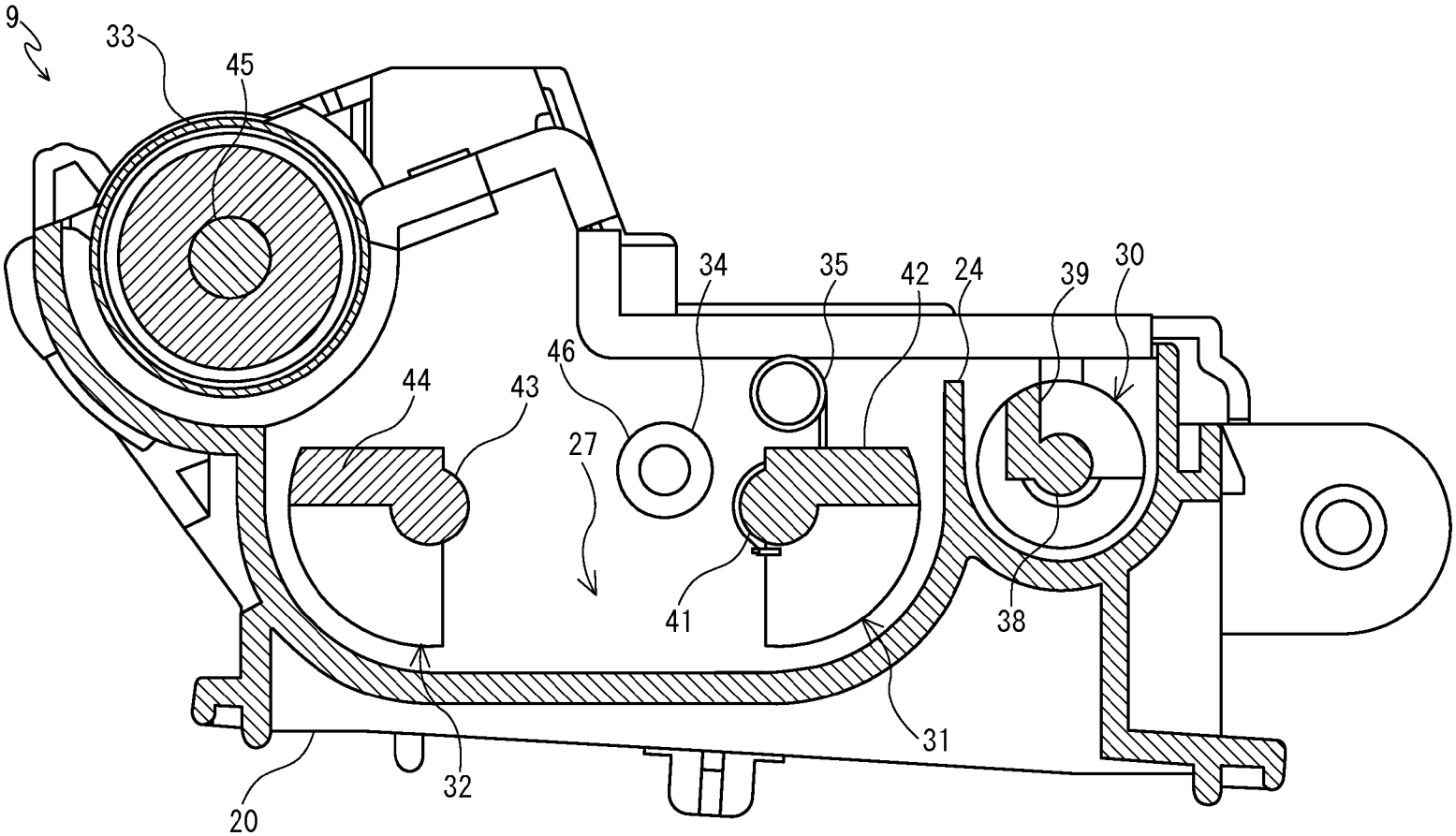
FIG. 5 is a sectional view of the developing device in the printer in accordance with the embodiment of the present disclosure.
Figure 6:
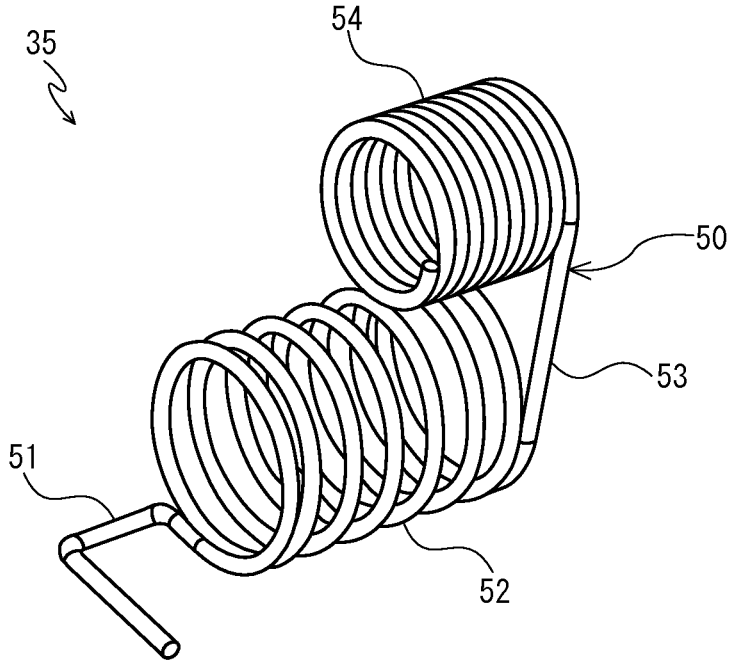
FIG. 6 is a perspective view showing a cleaning member in the developing device of the printer in accordance with the embodiment of the present disclosure.
Figure 7:
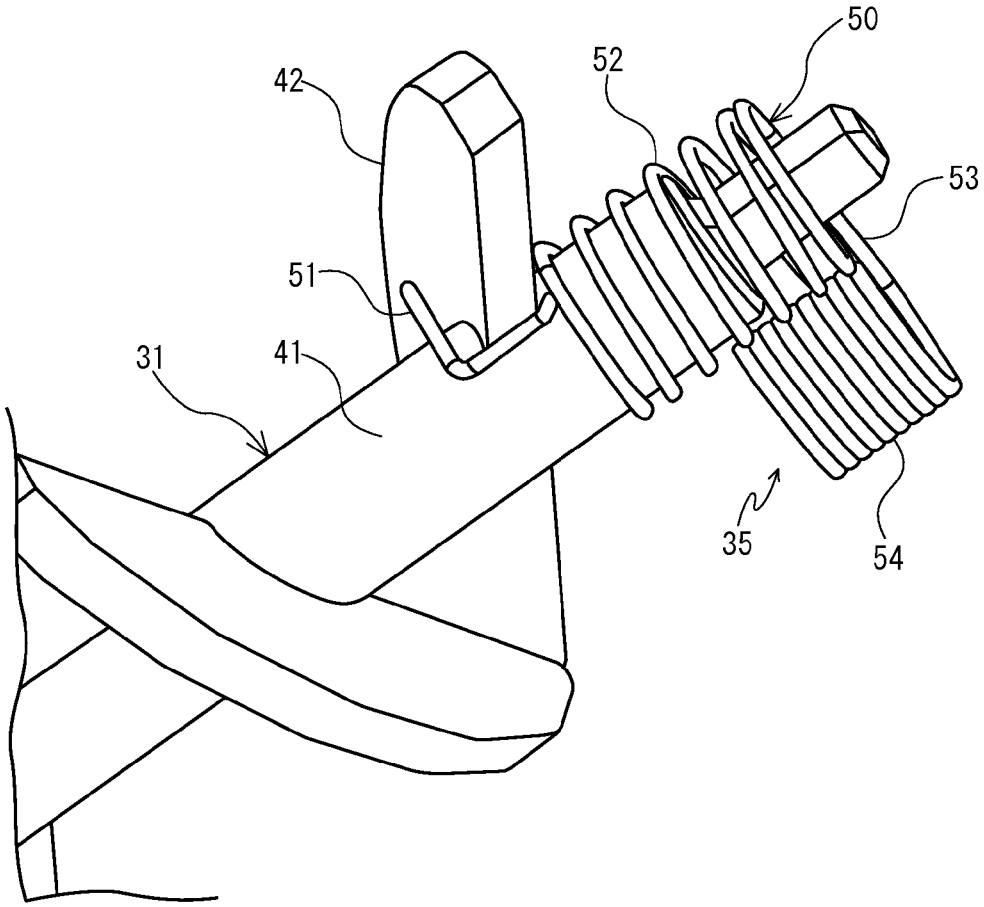
FIG. 7 is a perspective view showing the developing device, in a state that the cleaning member is attached to a first agitating screw, in the printer in accordance with the embodiment of the present disclosure.

Next, with reference to FIGS. 5 and 6, the cleaning member 35 will be described in detail. FIG. 5 is a sectional view of the developing device in the printer in accordance with the embodiment of the present disclosure. FIG. 6 is a perspective view showing the cleaning member of the developing device of the printer in accordance with the embodiment of the present disclosure.

The cleaning member 35, as shown in FIGS. 5 and 6, is formed of a line of metal wire 50 having elasticity. From a distal end to a rear end of the wire 50, an engaging stop part 51, an attachment part 52, a first cleaning part 53 and a second cleaning part 54 are formed continuously in that order. The cleaning member 35 is attached to the end part of the first agitating screw 31 at a side other than the side where the cleaning member 35 is connected to the drive force transmission mechanism 37. The engaging stop part 51 and attachment part 52 have a function of attaching the cleaning member 35 to the first agitating screw 31. The first cleaning part 53 has a function of clearing the developer adhered on the detecting surface 46 of the developer amount detecting part 34. The second cleaning part 54 has a function of clearing the developer on a location apart forwardly from the detecting surface 46.

The engaging stop part 51 is formed by bending a distal end of the wire 50 into a general U shape, is stopped in an engaging state to the first agitating screw 31, for example, by clamping an end part of the first agitating vane member 42.

The attachment part 52 is a coil spring formed by bending into a helical shape an end part of the wire 50 being successive from the engaging stop part 51. The attachment part 52 is attached by inserting the first agitating rotation shaft 41 into a hollow portion of the helical shape. Incidentally, the helix of the attachment part 52 extends longer than the distance from the end part of the first agitating vane member 42 to the inner side surface of the housing 19, and is formed in a coarse winding fashion in which turns are spaced from each other by predetermined intervals. Due to this construction, when the first agitating screw 31 has been attached to the housing 19, the attachment part 52 biases the first cleaning part 53 and second cleaning part 54 so that they are pressed against the inner side surface of the housing 19, and biases their in a return direction against load in the winding direction.

The first cleaning part 53 is formed by an intermediate part of the wire 50 being successive from the attachment part 52, and extends toward an outer peripheral side of the helix of the attachment part 52, that is, in a direction orthogonal to the axis of the first agitating screw 31. Incidentally, the first cleaning part 53 may be formed in a linear shape that extends from the end part of the first agitating screw 31 so as to reach the detecting surface 46 of the developer amount detecting part 34. That is, the first cleaning part 53 linearly extends from the end part of the first agitating rotation shaft 41 along the inner side surface of the housing 19 and reaches the detecting surface 46 of the developer amount detecting part 34 in a direction orthogonal to the axis of the first agitating rotation shaft 41.

The second cleaning part 54 is formed of another end part of the wire 50 being successive from the first cleaning part 53 by bending the wire 50 so that adjacent turns of the wire 50 are closely contiguous to each other, and is formed so as to be projected to a location in front of the detecting surface 46 of the developer amount detecting part 34 and have a greater width than the detecting surface 46. For example, the second cleaning part 54 is formed by bending the wire 50 into a helical shape that extends in a direction away from the detecting surface 46 of the developer amount detecting part 34 to a location in front of the detecting surface 46. This helix is closely wound, and has a greater diameter or width than the detecting surface 46 of the developer amount detecting part 34. The second cleaning part 54 turns around the first agitating rotation shaft 41, with the center of turn being the axis of the first agitating rotation shaft 41, as the first agitating screw 31 rotates, and therefore, has a cleaning surface that faces opposing the turning direction of the second cleaning part 54. That is, the second cleaning part 54 is formed by bending the other end part of the wire 50 round a plurality of times. The bent parts of the second cleaning part 54, that is, the turns of the helix, are closely contiguous to each other in a direction orthogonal to the turning direction of the second cleaning part 54.

Next, as for the cleaning member 35 of the developing device 9 constructed as mentioned above, cleaning operation performed as the first agitating screw 31 rotates will be described.

Firstly, in the developing device 9, when drive force from a drive source (not shown) is inputted to the first drive force input part 36, the drive force is transmitted to the first agitating screw 31 via the drive force transmission mechanism 37. The first agitating rotation shaft 41 of the first agitating screw 31 rotates according to the drive force, together with the first agitating vane member 42. Then, the developer conveyed from the conveying screw 30 is agitated by rotation of the first agitating vane member 42, and is further conveyed to the second agitating screw 32 via one gap 27 of the second partition 25.

At this time, as the first agitating screw 31 rotates, the cleaning member 35 attached to the first agitating screw 31 turns in the same direction.

Then, when the first cleaning part 53 of the cleaning member 35 turns along the inner side surface of the housing 19, the first cleaning part 53 passes over and has sliding friction against the detecting surface 46 of the developer amount detecting part 34, so that the developer stagnating and adhered on the detecting surface 46 is scraped and cleared by the first cleaning part 53.

In addition, the second cleaning part 54 of the cleaning member 35 turns around the first agitating rotation shaft 41 and thus passes through the location in front of the detecting surface 46 of the developer amount detecting part 34, so that the second cleaning part 54 removes and clears the developer stagnating and adhered at the location in front of the detecting surface 46.

In this embodiment, the cleaning member 35 made of a line of metal wire 50 having elasticity includes the attachment part 52 attached to the first agitating screw 31, the first cleaning part 53 extending from the end part of the first agitating screw 31 so as to reach the detecting surface 46 of the developer amount detecting part 34, and the second cleaning part 54 formed by bending the wire 50 so that adjacent turns of the wire 50 are closely contiguous to each other and so that the second cleaning part 54 is protruded to a location in front of the detecting surface 46 of the developer amount detecting part 34 and has a greater width than the detecting surface 46. Therefore, the first cleaning part 53 can be caused to pass over the detecting surface 46 of the developer amount detecting part 34, and the second cleaning part 54 can be caused to pass through the location in front of the detecting surface 46. Due to this, it is possible to clear the developer adhered on the detecting surface 46 by the first cleaning part 53 and to clear the developer adhered in front of the detecting surface 46 by the second cleaning part 54. Since the cleaning member 35 is formed from one line of wire 50, it is possible to clear the developer adhered over the large detection range of the detecting surface 46 by using a simple construction that reduces the number of man-hours for production and the production cost. Therefore, the developer on and around the detecting surface 46 of the developer amount detecting part 34 is sufficiently agitated by the first agitating screw 31 and second agitating screw 32. Hence, the developer amount detecting part 34 is able to accurately detect the amount of the development in the housing 19 even in the case where the detection range is large. That is, according to the present disclosure, it is possible to clear the developer adhered over the large detection range of the developer amount detecting part while reducing the number of man-hours for production and the production cost.

Figure 8:
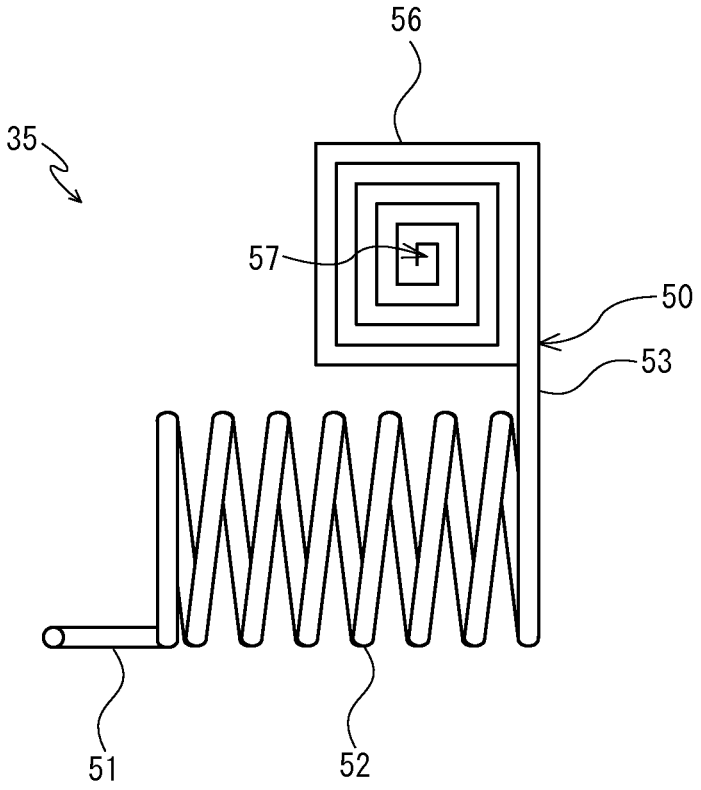
FIG. 8 is a partial schematic diagram schematically showing a cleaning member in accordance with another embodiment of the present disclosure.

Although this embodiment has been described in conjunction with the second cleaning part 54 formed by bending the other end part of the wire 50 into a helical shape, this is not restrictive. In a different embodiment, the cleaning member 35 may be equipped with, for example, a second cleaning part 56 wound in a spiral shape as show in FIG. 8, instead of the helical second cleaning part 54. The spiral of this second cleaning part 56 is formed by first winding a portion of the wire 50 being successive from the first cleaning part 53 so that the wound portion becomes an outer periphery and converges to a center part 57 apart from the first cleaning part 53. This center part 57 is provided in front of the detecting surface 46 of the developer amount detecting part 34, and the spiral of the second cleaning part 56 makes a plane perpendicular to the detecting surface 46. Incidentally, this spiral second cleaning part 56 is not limited to a square winding as shown in FIG. 8, but may also be formed in other shapes, such as a circular shape, an elliptic shape, a round-corner rectangle or other shapes. The second cleaning part 56 may be successive, at its the outer periphery of the spiral shape, to the first cleaning part 53, this is not restrictive. The second cleaning part 56 may also be successive, at the center part 57, to the first cleaning part 53, and the spiral shape may be formed so as to expand from the center part 57 in orthogonal directions as mentioned above.

As described above, the second cleaning part 54 is formed by bending the other end part of the wire 50 into a helical shape, or the second cleaning part 56 is formed by bending the other end part of the wire 50 into a spiral shape. Therefore, it is easy to form the second cleaning part 54 or 56 by bending the wire 50 so that adjacent portions of the wire 50 are closely contiguous to each other and so that the second cleaning part 54 or 56 is protruded to a location in front of the detecting surface 46 of the developer amount detecting part 34 and has a greater width than the detecting surface 46.

As described above, the attachment part 52 is formed by bending the end part of the wire 50 into a helical shape, and the cleaning member 35 is attached to the first agitating screw 31 by inserting the first agitating screw 31 into the hollow portion of the helical shape. Therefore, the first cleaning part 53 and second cleaning part 54 are biased by the attachment part 52 to pass over the detection range of the developer amount detecting part 34, so that the developer stagnating in this range can be efficiently cleared.

This embodiment has been described in conjunction with the construction in which the cleaning member 35 is equipped with the engaging stop part 51 that clamps an end part of the first agitating vane member 42 in order to stop in an engaging state the cleaning member 35 to the first agitating screw 31, this is not restrictive. For example, it is also permissible to provide, for example, a construction in which the first agitating rotation shaft 41 of the first agitating screw 31 is provided with a groove-shaped or hole-shaped engagement reception part (not shown) and the engagement reception part is engaged with the engaging stop part 51.

Still further, although this embodiment has been described in conjunction with the magnetic permeability sensor provided as the developer amount detecting part 34, this is not restrictive. The developer amount detecting part 34 may also be constructed of a piezoelectric sensor or an optical sensor.

Although this embodiment has been described in conjunction with the case where the construction of the present disclosure is applied to the printer 1, the construction of the present disclosure may be applied in different embodiments to image forming apparatuses, such as a copying machine, a facsimile, a multifunction peripheral or the like.

Although in the embodiment, the construction of the present disclosure is applied to the developing device 9 to which the developer is supplied from the developer case 12, the construction of the present disclosure may also be applied, in a different embodiment, to an intermediate hopper provided between the developer case 12 and developing device 9, or other cases that contain the developer.

While the present disclosure has been described with reference to the particular illustrative embodiments, it is not to be restricted by the embodiments. It is to be appreciated that those skilled in the art can change or modify the embodiments without departing from the scope and spirit of the present disclosure.

What is claimed is:

1. A developing device comprising:

an agitating member configured to agitate a developer by rotating in a casing that contains the developer;

a developer amount detecting part configured to detect amount of the developer in the casing;

a cleaning member attached to the agitating member and configured to clean a detecting surface of the developer amount detecting part, wherein the cleaning member includes:

an attachment part formed by an end part of a wire and attached to the agitating member, a first cleaning part formed by an intermediate part of the wire being successive from the attachment part, and configured to extend from an end part of the attachment part so as to reach the detecting surface of the developer amount detecting part, and a second cleaning part formed by an another end part of the wire being successive from the first cleaning part and formed by bending the wire so that adjacent portions of the wire are closely contiguous to each other, so as to be protruded to a location in front of the detecting surface of the developer amount detecting part and to have a greater width than the detecting surface, wherein the attachment part is formed by bending the end part of the wire in a helical shape, and the cleaning member is attached to the agitating member as a rotation shaft of the agitating member is inserted in a hollow portion of the helical shape, when the agitating member has been attached to the casing, the attachment part biases the first cleaning part and the second cleaning part so that the first and second cleaning parts are pressed against an inner side surface of the casing, the second cleaning part turns around the agitation member, with a center of turn being an axis of the rotation shaft of the agitating member, as the agitating member rotates, bent parts of the second cleaning part are closely contiguous to each other in a direction orthogonal to a turning direction of the second cleaning part, the first cleaning part is configured to clear the developer adhered on the detecting surface and the second cleaning part is configured to clear the developer on a location apart forwardly from the detecting surface.

2. The developing device according to claim 1, wherein the second cleaning part is formed by bending the another end part of the wire in a helical shape.

3. The developing device according to claim 1, wherein the second cleaning part is formed by bending the another end part of the wire in a spiral shape.

4. An image forming apparatus comprising:

a developing device, wherein the developing device includes:

an agitating member configured to agitate a developer by rotating in a casing that contains the developer;

a developer amount detecting part configured to detect amount of the developer in the casing;

a cleaning member attached to the agitating member and configured to clean a detecting surface of the developer amount detecting part, wherein the cleaning member includes:

an attachment part formed by an end part of a wire and attached to the agitating member, a first cleaning part formed by an intermediate part of the wire being successive from the attachment part, and configured to extend from an end part of the attachment part so as to reach the detecting surface of the developer amount detecting part, and a second cleaning part formed by an another end part of the wire being successive from the first cleaning part, the second cleaning part being formed by bending the wire so that adjacent portions of the wire are closely contiguous to each other, so as to be protruded to a location in front of the detecting surface of the developer amount detecting part and to have a greater width than the detecting surface, wherein the attachment part is formed by bending the end part of the wire in a helical shape, and the cleaning member is attached to the agitating member as a rotation shaft of the agitating member is inserted in a hollow portion of the helical shape, when the agitating member has been attached to the casing, the attachment part biases the first cleaning part and second cleaning part so that the first and second cleaning parts are pressed against an inner side surface of the casing, the second cleaning part turns around the agitation member, with a center of turn being an axis of the rotation shaft of the agitating member, as the agitating member rotates, bent parts of the second cleaning part are closely contiguous to each other in a direction orthogonal to a turning direction of the second cleaning part, the first cleaning part is configured to clear the developer adhered on the detecting surface and the second cleaning part is configured to clear the developer on a location apart forwardly from the detecting surface.

5. The image forming apparatus according to claim 4, wherein the second cleaning part is formed by bending the another end part of the wire in a helical shape.

6. The image forming apparatus according to claim 4, wherein the second cleaning part is formed by bending the another end part of the wire in a spiral shape.

7. A cleaning member, which is configured to clean a detecting surface of a developer amount detecting part of a developing device, comprising:

an attachment part formed by an end part of a wire and configured to be attached to the agitating member of the developing device;

a first cleaning part formed by an intermediate part of the wire being successive from the attachment part, and configured to extend from an end part of the attachment part so as to reach the detecting surface of the developer amount detecting part; and a second cleaning part formed by an another end part of the wire being successive from the first cleaning part and formed by bending the wire so that adjacent portions of the wire are closely contiguous to each other, so as to be protruded to a location in front of the detecting surface of the developer amount detecting part and to have a greater width than the detecting surface, wherein the attachment part is formed by bending the end part of the wire in a helical shape, and the cleaning member is attached to the agitating member as a rotation shaft of the agitating member is inserted in a hollow portion of the helical shape, when the agitating member has been attached to the casing, the attachment part biases the first cleaning part and second cleaning part so that the first and second cleaning parts are pressed against an inner side surface of the casing, the second cleaning part turns around the agitation member, with a center of turn being an axis of the rotation shaft of the agitating member, as the agitating member rotates, bent parts of the second cleaning part are closely contiguous to each other in a direction orthogonal to a turning direction of the second cleaning part, the first cleaning part is configured to clear the developer adhered on the detecting surface and the second cleaning part is configured to clear the developer on a location apart forwardly from the detecting surface.

8. The cleaning member according to claim 7, wherein the second cleaning part is formed by bending the another end part of the wire in a helical shape.

9. The cleaning member according to claim 7, wherein the second cleaning part is formed by bending the another end part of the wire in a spiral shape.

* * * * *